US005816577A

United States Patent [19]

Preston et al.

[11] Patent Number: 5,816,577

[45] Date of Patent: Oct. 6, 1998

[54] GAME OF CHANCE MATCHING GAME AND METHOD THEREFOR

[76] Inventors: Mark Preston, 15446 E. Chicory, Fountain Hills, Ariz. 85268; Frank Vawter, 2327 N. Kachina St., Mesa, Ariz. 85203

[21] Appl. No.: 954,402

[22] Filed: Oct. 20, 1997

[51] Int. Cl.[6] ..... A63F 1/00

[52] U.S. Cl. ..... 273/292

[58] Field of Search ..... 273/274, 292, 273/303, 304, 305, 306

[56] References Cited

U.S. PATENT DOCUMENTS 5,431,407 7/1995 Hofberg et al. ..... 273/292
5,496,038 3/1996 Kangsanaraks ..... 273/292
5,601,488 2/1997 Kadlic ..... 273/292 X
5,636,843 6/1997 Roberts ..... 273/292
5,713,573 2/1998 Nazaryan ..... 273/292

*Primary Examiner*—William E. Stoll
*Attorney, Agent, or Firm*—Harry M. Weiss; Jeffrey D. Moy; Harry M. Weiss & Associates, P.C.

[57] ABSTRACT

A method of playing a game of chance matching game. An ante is posted by each participating player to form a winning pot. Each participating player is given a pre-determined number of objects from a first set of objects. A game controller draws a first object from a second identical set of objects and shows the drawn first object to the participating players. A predetermined amount of credits is given to any participating player having an object from the first set of objects given to the participating player matching the first object drawn from the second set of objects.

21 Claims, 1 Drawing Sheet

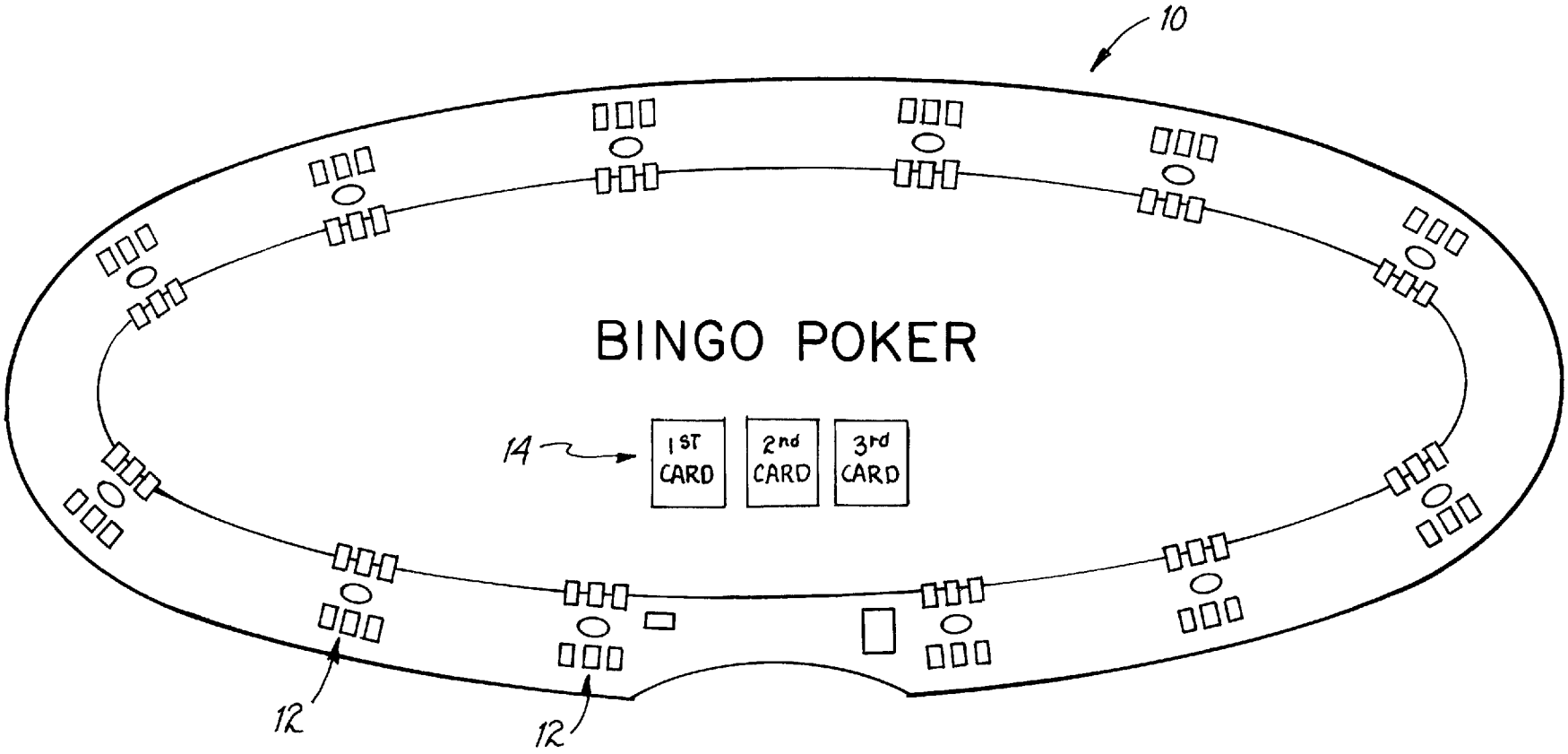
10
BINGO POKER
1ST CARD
2nd CARD
3rd CARD
14
12
12

GAME OF CHANCE MATCHING GAME AND METHOD THEREFOR

BACKGROUND OF THE INVENTION

1. Field of the Invention

This invention relates generally to games, and more specifically, to combination bingo and poker game in which participants require no specific skills in order to play and where every participant has an equal opportunity to win.

2. Background of the Invention

Various forms of games of chance are played throughout the world (i.e., poker, blackjack, etc.). The problem with each of these different games is that participants need to have some basic fundamental skills if the participant is to have any chance of winning. Many participants who have these skills are often able to take advantage of participants who do not know or have not learned these basic fundamental skills.

Therefore a need existed to provide a new type of game of chance. The new game of chance will not require any specific skills in order to play. As a result, the new game of chance will not allow any participant to have a favorable advantage over the other participants. The new game of chance allows each of the participants to have an equal opportunity of winning. This is due to the 100% random distribution of winning opportunities.

SUMMARY OF THE INVENTION

In accordance with one embodiment of the present invention, it is an object of the present invention to provide a new type of game of chance.

It is another object of the present invention to provide a new game of chance that does not require any specific skills in order to play.

It is a further object of the present invention to provide a new game of chance that does not require any specific skills in order to play thereby allowing none of the participants to have a favorable advantage over the other participants.

It is still another object of the present invention to provide a new game of chance that allows each of the participants to have an equal opportunity of winning.

It is yet another object of the present invention to provide a new game of chance that allows each of the participants to have an equal opportunity of winning due to the 100% random distribution of winning opportunities.

BRIEF DESCRIPTION OF THE PREFERRED EMBODIMENTS

In accordance with one embodiment of the present invention, a method of playing a game of chance matching game is disclosed. The method comprises the steps of: posting an ante by each participating player to form a winning pot; mixing up a first set of objects; dealing each of the participating players a predetermined number of objects from the first set of objects; providing a second set of objects identical to the first set of objects; mixing up the second set of objects by a game controller; drawing of a first object from the second set of objects by the game controller and showing the first object to the participating players; and placing a predetermined amount of credits on any participating player having an object from the first set of objects matching the first object from the second set of objects. The method may further comprises the step of drawing objects from the second set of objects by the game controller and showing each object drawn to the participating players and placing a predetermined amount of credits on any participating player having objects from the first set of objects matching objects from the second set of objects until one of the participating players has matched each of the objects from the first set of objects given to that participating player. In the alternative, the method may comprise the steps of drawing a predetermined number of objects from said second set of objects by the game controller and showing each object drawn to said participating players; and placing a predetermined amount of credits on any participating player having an object from the first set of objects matching an object from the predetermined number of objects drawn from the second set of objects.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

FIG. 1 shows one embodiment of the playing surface used with the present invention.

DETAILED DESCRIPTION OF THE PREFERRED EMBODIMENTS

Each participant will post an equal pre-determined ante to participate in each round. The ante is collected together to create the nucleus of the pot. From the pot, a pre-determined amount may be taken for an accumulating jackpot (i.e. progressive jackpot) if one is desired.

After an ante has been posted by each participant, each participant will be given a pre-determined number of random assortment of basic object criteria, commonly referred to as a participant's hand 12, from a set package. The basic object criteria can be in the form of numbers, dominoes, dice/cubes, etc. In the preferred embodiment of the present invention, a fifty-two card playing deck is used.

A second set package identical to the first set package is handled by a game controller. The game controller will draw a pre-determined number of random assortment of basic object criteria from the second set package (hereinafter referred to as controller's hand 14). The objects of the controller's hand 14 are placed on the playing surface 10 one object at a time. As the objects of the controller's hand 14 are individually placed on the playing surface 10, the participants will compare individual objects of each participant's hand 12 to determine if there is a match to a corresponding object of the controller's hand 14 (i.e., commonly referred to as a hit).

A hand is complete when an individual participant has received a hit on each of the individual objects of the participant's hand 12. When this occurs, that participant will receive a predetermined amount from the pot. If all of the objects of the controller's hand 14 have been placed on the playing surface and none of the participants have matched all of their objects, some predetermined method may determined the participant who has won that round. For example, the participants who has the most hits may be the winner of the hand. If more than one participant has the highest number of hits, the participants with the highest valued object may be declared the winner of the round.

If an accumulating jackpot is utilized in the game, participants may receive a predetermined amount of the jackpot based upon a matching a pre-determined schedule of jackpot events. For example, the participant may receive a predetermined amount from the jackpot for various pre-determined combinations of the participant's objects. The participant may also receive a predetermined amount from the jackpot for exactly matching the objects of the controller's hand 14 in the exact sequential order as they are placed on the playing surface 10.

In accordance with one embodiment of the present invention, the game is played in the following manner. Each player shall ante a pre-determined amount on the playing surface 10. The game controller will collect each player's ante and place it in the center of the playing surface 10. The game controller will take a first standard deck of fifty-two playing cards (i.e., a deck with four suits wherein each suit contains 13 ranks from a high ace to a low two) and thoroughly shuffle the first deck. The game controller will then deal one card to each player until each player has received three cards. Each player will place their individual cards face up and adjacent to one another on the playing surface 10 in front of that particular player.

While each player places their individual cards face up on the playing surface 10, the game controller shall take and thoroughly shuffle a second identical standard deck of fifty-two playing cards (i.e., game controller's deck). Once all the players have placed their respective cards face up on the playing surface 10, the game controller will show the top card from the game controller's deck. The card will be placed face up in front of the game controller on the playing surface 10.

Any player having a rank of a card in their hand matching the rank of the card that the game controller has turned over has a hit. The players with a hit will place a pre-determined amount of money from each player's cash reserve and place the money in front of the matching card 16 on the playing surface 10. This money then becomes part of the pot.

The game controller will continue to place cards face up in front of the game controller on the playing surface 10 until one of two things occur. If any player has received a hit on each of the player's cards, that player shall receive the pot. Should two or more individual players tie, then the pot is divided equally among each winner. If the game controller has turned over a predetermined number of cards and no player has received a hit on each of the player's cards, the player with the highest ranking hand will receive the pot. The ranking of the hands should be based on probability with the least likely hand being the highest and the easiest hand being the lowest. For example, three matching cards (i.e., same rank) would be the highest hand while the lowest winning hand would be the highest ranking card with on one else having matching rank cards. If none of the players match any of the cards (i.e., not one card having the same rank as the game controller's hand), then the pot is not distributed. Once again, should two or more individual players tie, then the pot is divided equally among each winner.

Various modifications could be made to the game. For example, when a player has a hit, instead of the player placing money in front of the matching card and increasing the pot, the game controller will place a pre-determined amount of money from the pot in front of the matching card 16 on the playing surface 10. This money then becomes part of the player's winnings. Further modifications include having each player become a nonparticipating player game controller on a rotating basis. The nonparticipating player game controller will take and thoroughly shuffle the second identical standard deck of fifty-two playing cards. Once all the players have placed their respective cards face up on the playing surface 10, the nonparticipating player game controller will take the top card from the second deck and place the card face up in front of the playing surface 10. The remainder of this embodiment is the same as described above. Furthermore, the game may be a house banked game or a non-house banked game. The game may further be implemented via electronic means (i.e., computer version).

While the invention has been particularly shown and described with reference to preferred embodiments thereof, it will be understood by those skilled in the art that the foregoing and other changes in form and details may be made therein without departing from the spirit and scope of the invention.

What is claimed is:

1. A method of playing a game of chance matching game comprising the steps of:

posting an ante by each participating player to form a winning pot;

mixing up a first set of objects;

dealing each of said participating players a predetermined number of said objects from said first set of objects;

providing a second set of objects identical to said first set of objects;

mixing up said second set of objects by a game controller;

drawing of a first object from said second set of objects by said game controller and showing said first object to said participating players; and placing a predetermined amount of credits on any participating player having an object from said first set of objects matching said first object from said second set of objects.

2. The method of claim 1 further comprising the step of drawing of objects from said second set of objects by said game controller and showing each object drawn to said participating players and placing said predetermined amount of credits on any participating player having objects from said first set of objects matching objects from said second set of objects until one of said participating players has matched each of said objects from said first set of objects given to said participating player.

3. The method of claim 2 further comprising the step of giving said winning pot to said participating players having first matched each of said objects from said first set of objects given to said participating player.

4. The method of claim 2 wherein said predetermined amount of credits placed on any participating player having objects from said first set of objects matching objects from said second set of objects comes from said participating player having matching objects wherein said predetermined amount of credits become part of said winning pot.

5. The method of claim 2 wherein said predetermined amount of credits placed on any participating player having objects from said first set of objects matching objects from said second set of objects comes from said winning pot, said predetermined amount of credits placed on said participating player having objects from said first set of objects matching objects from said second set of objects becoming winnings of said participating player.

6. The method of claim 1 wherein said step of posting an ante by each participating player to form a winning pot further comprises the step of removing a portion of said winning pot to form a jackpot wherein said jackpot is given to a participating player having matched a pre-determined schedule of jackpot events.

7. The method of claim 1 further comprising the steps:

drawing a predetermined number of objects from said second set of objects by said game controller and showing each object drawn to said participating players; and placing said predetermined amount of credits on any participating player having an object from said first set of objects matching an object from said predetermined number of objects drawn from said second set of objects.

8. The method of claim 7 wherein said predetermined amount of credits placed on any participating player having objects from said first set of objects matching objects from said second set of objects comes from said participating player having matching objects wherein said predetermined amount of credits become part of said winning pot.

9. The method of claim 7 wherein said predetermined amount of credits placed on any participating player having objects from said first set of objects matching objects from said second set of objects comes from said winning pot, said predetermined amount of credits placed on said participating player having objects from said first set of objects matching objects from said second set of objects becoming winnings of said participating player.

10. The method of claim 7 further comprising the step of giving said participating player having a highest ranking hand said winning pot.

11. The method of claim 1 wherein said game controller is a participating player who is not playing a current round.

12. The method of claim 10 wherein said game controller who is a participating player who is not playing a current round rotates among said participating players each round.

13. The method of claim 1 wherein said first set of objects and said second set of objects are a first deck of fifty-two playing cards and a second set fifty-two playing cards.

14. The method of claim 13 wherein an object from said first set of objects matching said first object from said second set of objects requires matching rank of cards from said first and said second deck of fifty-two playing cards.

15. The method of claim 13 wherein an object from said first set of objects matching said first object from said second set of objects requires matching rank and suit of cards from said first and said second deck of fifty-two playing cards.

16. A method of playing a game of chance matching game comprising the steps of:

posting an ante by each participating player to form a winning pot;

mixing up a first set of objects;

dealing each of said participating players a predetermined number of said objects from said first set of objects;

providing a second set of objects identical to said first set of objects;

mixing up said second set of objects by a game controller;

drawing of a first object from said second set of objects by said game controller and showing said first object to said participating players;

placing a predetermined amount of credits on any participating player having an object from said first set of objects matching said first object from said second set of objects;

drawing of objects from said second set of objects by said game controller and showing each object drawn to said participating players and placing said predetermined amount of credits on any participating player having objects from said first set of objects matching objects from said second set of objects until one of said participating players has matched each of said objects from said first set of objects given to said participating player;

giving said winning pot to said participating players having first matched each of said objects from said first set of objects given to said participating player.

17. The method of claim 16 wherein said predetermined amount of credits placed on any participating player having objects from said first set of objects matching objects from said second set of objects comes from said participating player having matching objects wherein said predetermined amount of credits become part of said winning pot.

18. The method of claim 16 wherein said predetermined amount of credits placed on any participating player having objects from said first set of objects matching objects from said second set of objects comes from said winning pot, said predetermined amount of credits placed on said participating player having objects from said first set of objects matching objects from said second set of objects becoming winnings of said participating player.

19. A method of playing a game of chance matching game comprising the steps of:

posting an ante by each participating player to form a winning pot;

mixing up a first set of objects;

dealing each of said participating players a predetermined number of said objects from said first set of objects;

providing a second set of objects identical to said first set of objects;

mixing up said second set of objects by a game controller;

drawing of a first object from said second set of objects by said game controller and showing said first object to said participating players;

placing a predetermined amount of credits on any participating player having an object from said first set of objects matching said first object from said second set of objects;

drawing a predetermined number of objects from said second set of objects by said game controller and showing each object drawn to said participating players;

placing said predetermined amount of credits on any participating player having an object from said first set of objects matching an object from said predetermined number of objects drawn from said second set of objects;

giving said participating player having a highest ranking hand said winning pot.

20. The method of claim 19 wherein said predetermined amount of credits placed on any participating player having objects from said first set of objects matching objects from said second set of objects comes from said participating player having matching objects wherein said predetermined amount of credits become part of said winning pot.

21. The method of claim 19 wherein said predetermined amount of credits placed on any participating player having objects from said first set of objects matching objects from said second set of objects comes from said winning pot, said predetermined amount of credits placed on said participating player having objects from said first set of objects matching objects from said second set of objects becoming winnings of said participating player.

* * * * *